US011448058B2

(12) United States Patent
Gharib et al.

(10) Patent No.: US 11,448,058 B2
(45) Date of Patent: Sep. 20, 2022

(54) COMPREHENSIVE STRUCTURAL HEALTH MONITORING METHOD FOR BOTTOM HOLE ASSEMBLY

(71) Applicant: Halliburton Energy Services, Inc., Houston, TX (US)

(72) Inventors: Hossam Gharib, Edmonton (CA); Julien Marck, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 712 days.

(21) Appl. No.: 16/405,434

(22) Filed: May 7, 2019

(65) Prior Publication Data

US 2020/0355061 A1 Nov. 12, 2020

(51) Int. Cl.

| | |
|---|---|
| ***E21B 47/007*** | (2012.01) |
| ***E21B 47/08*** | (2012.01) |
| ***E21B 12/02*** | (2006.01) |
| ***E21B 41/00*** | (2006.01) |
| ***E21B 21/08*** | (2006.01) |
| *E21B 47/022* | (2012.01) |

(52) U.S. Cl.

CPC ..... *E21B 47/007* (2020.05); *E21B 12/02* (2013.01); *E21B 21/08* (2013.01); *E21B 41/0092* (2013.01); *E21B 47/08* (2013.01); *E21B 47/022* (2013.01); *E21B 2200/20* (2020.05)

(58) Field of Classification Search

CPC ..... E21B 47/007; E21B 12/02; E21B 47/08; E21B 2200/20

See application file for complete search history.

(56) References Cited

U.S. PATENT DOCUMENTS

| | | | | |
|---|---|---|---|---|
| 5,358,059 | A * | 10/1994 | Ho | E21B 49/003 175/45 |
| 6,068,394 | A * | 5/2000 | Dublin, Jr. | G01L 5/162 73/152.01 |
| 9,062,528 | B2 | 6/2015 | Mitchell et al. | |
| 9,359,882 | B2 | 6/2016 | Snyder | |
| 9,637,981 | B2 | 5/2017 | Kirkhope | |
| 10,139,326 | B2 | 11/2018 | Ba et al. | |
| 2011/0214878 | A1* | 9/2011 | Bailey | E21B 7/00 175/57 |
| 2015/0075274 | A1* | 3/2015 | Kpetehoto | E21B 47/007 73/152.48 |

(Continued)

*Primary Examiner* — Regis J Betsch

(74) *Attorney, Agent, or Firm* — Benjamin Ford; Parker Justiss, P.C.

(57) ABSTRACT

Conventional practice for determining a life expectancy of a drilling tool has been based on simple static bending moment evaluation and/or conservative past experience life limits. This archaic practice has often led to premature scrapping of the tools and has proven to be overly conservative and cost-ineffective. Introduced herein is a BHA condition monitoring technique that combines both field data and advanced models in one system. The introduced technique is based on a combination of system and component level models to monitor and evaluate the current health and life of BHA components. The introduced technique can apply to all directional drilling BHAs, including mud motors and rotary steerable systems, and can be used at different levels of the tool's life cycle to improve efficiency, reduce downhole failure incidents, and maximize assets' utilization.

20 Claims, 15 Drawing Sheets

(56) References Cited

U.S. PATENT DOCUMENTS

| | | | | |
|---|---|---|---|---|
| 2015/0337640 | A1 | 11/2015 | Huang et al. | |
| 2016/0178430 | A1* | 6/2016 | Holcomb | G01L 5/009 177/245 |
| 2016/0281489 | A1 | 9/2016 | Dykstra et al. | |
| 2017/0138157 | A1* | 5/2017 | Shen | E21B 44/00 |
| 2019/0345808 | A1* | 11/2019 | Suryadi | E21B 44/00 |

* cited by examiner

COMPREHENSIVE STRUCTURAL HEALTH MONITORING METHOD FOR BOTTOM HOLE ASSEMBLY

TECHNICAL FIELD

This application is directed, in general, to monitoring structural health of a bottom hole assembly, and more specifically, to utilizing multiple analysis modules to monitor structural health of bottom hole assembly components.

BACKGROUND

The oil and gas drilling industry is being forced to optimize operational cost while improving quality. One important aspect of optimizing operational cost is to maximizing the utilization of the drilling assets. One of the assets is a bottom hole assembly (BHA), which is a lower portion of a drill string that includes components such as a bit, a bit sub, a mud motor (in certain cases), stabilizers, drill collars, heavy-weight drillpipe, jars, and crossovers.

Conventionally, a BHA's operational limits have been chosen conservatively to avoid downhole failure. This conservative approach has often led to premature scrapping of BHAs and has resulted in the loss of millions of dollars in operational cost. As such, a comprehensive structural health monitoring system of a BHA that makes informed decisions to re-run, repair or scrap the BHA would be beneficial.

BRIEF DESCRIPTION

Reference is now made to the following descriptions taken in conjunction with the accompanying drawings, in which.

Figure 3A:
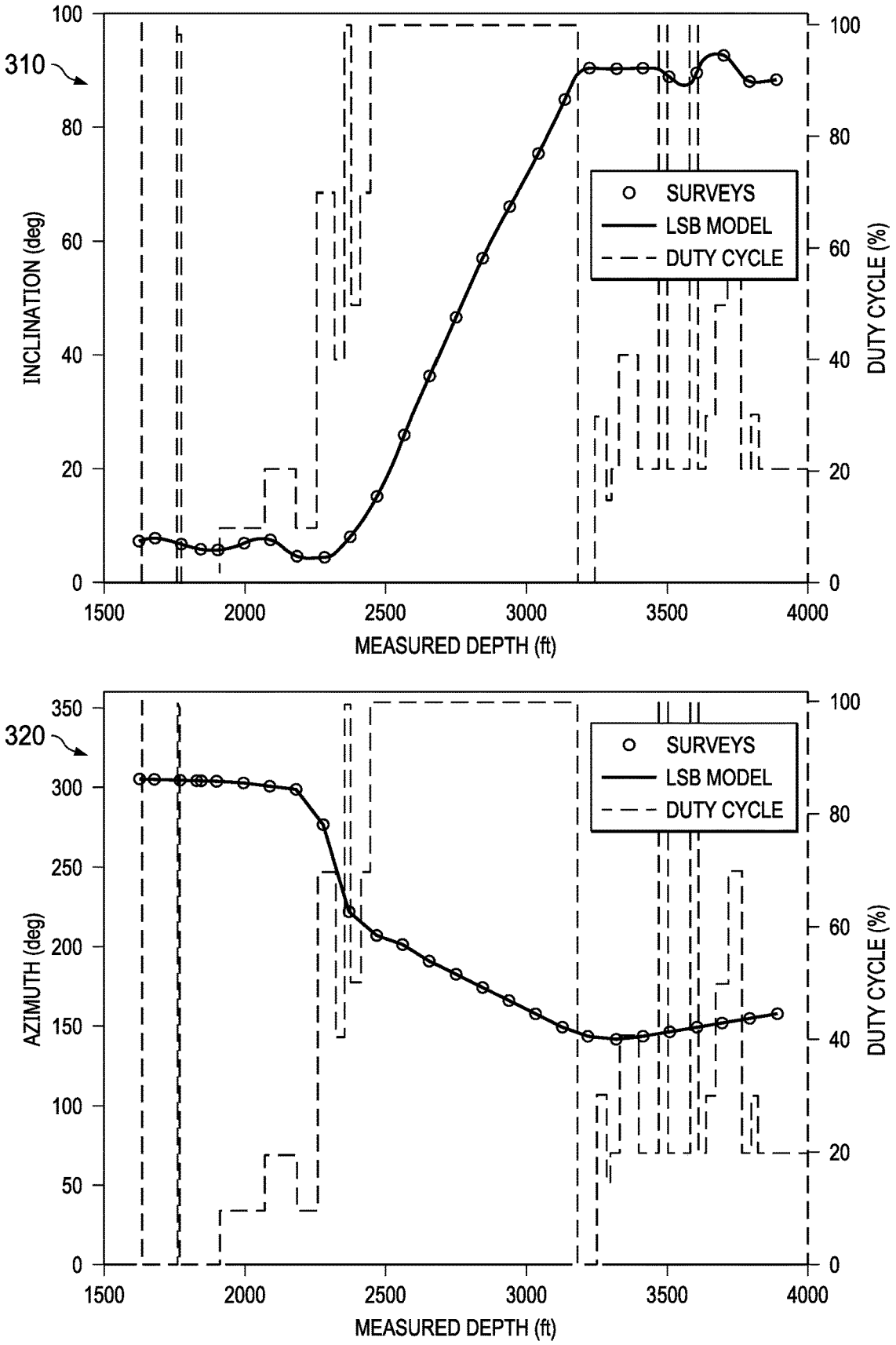
Figure 3B:
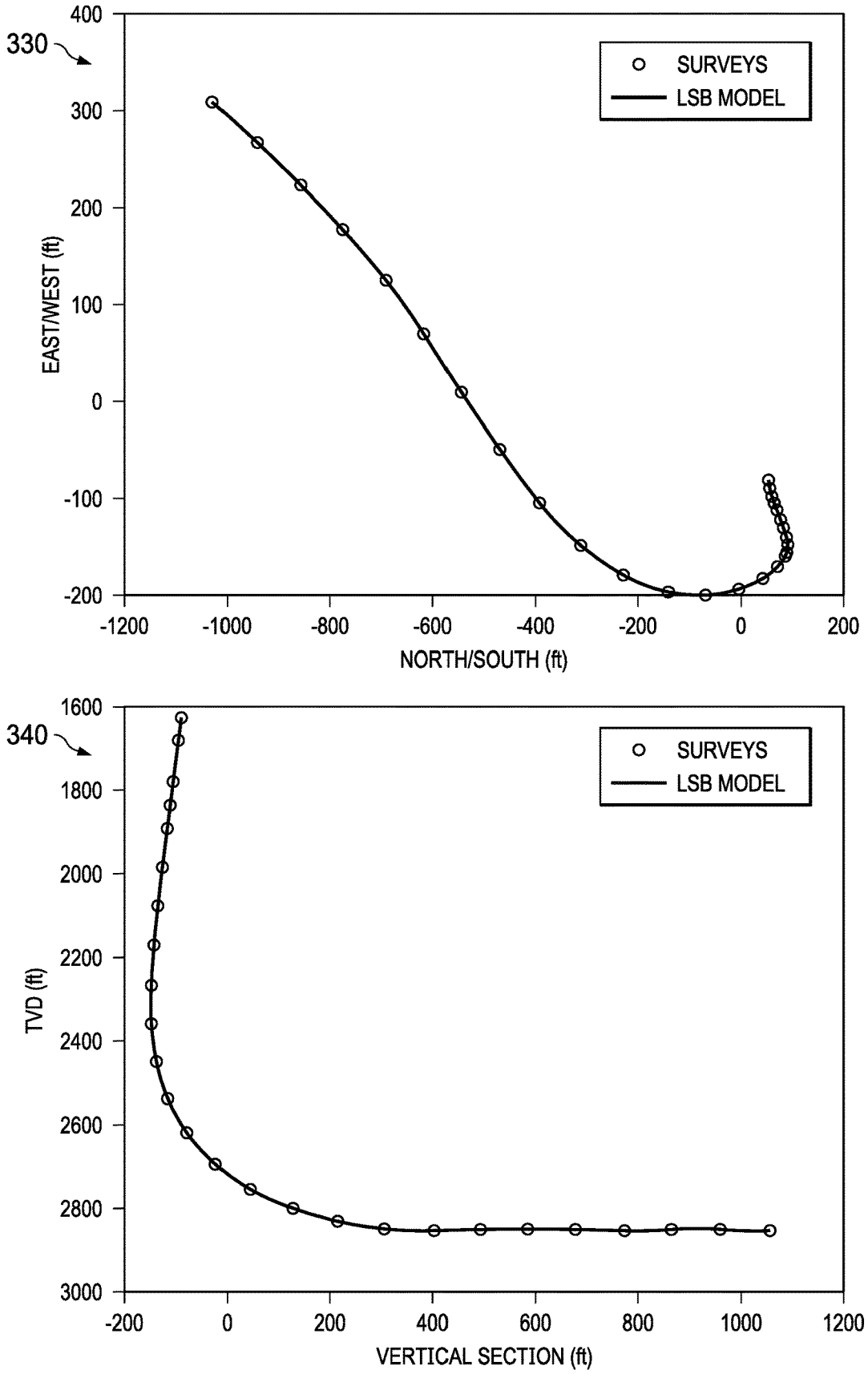
Figure 3C:
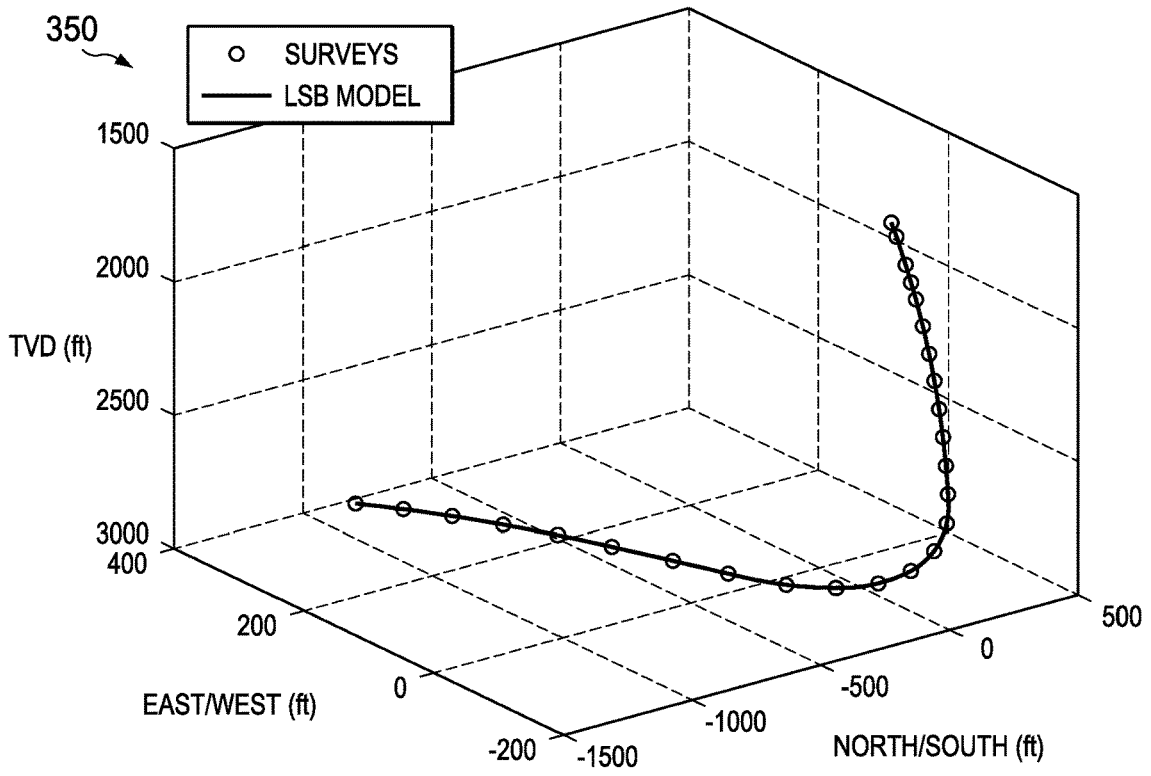
Figure 3C:
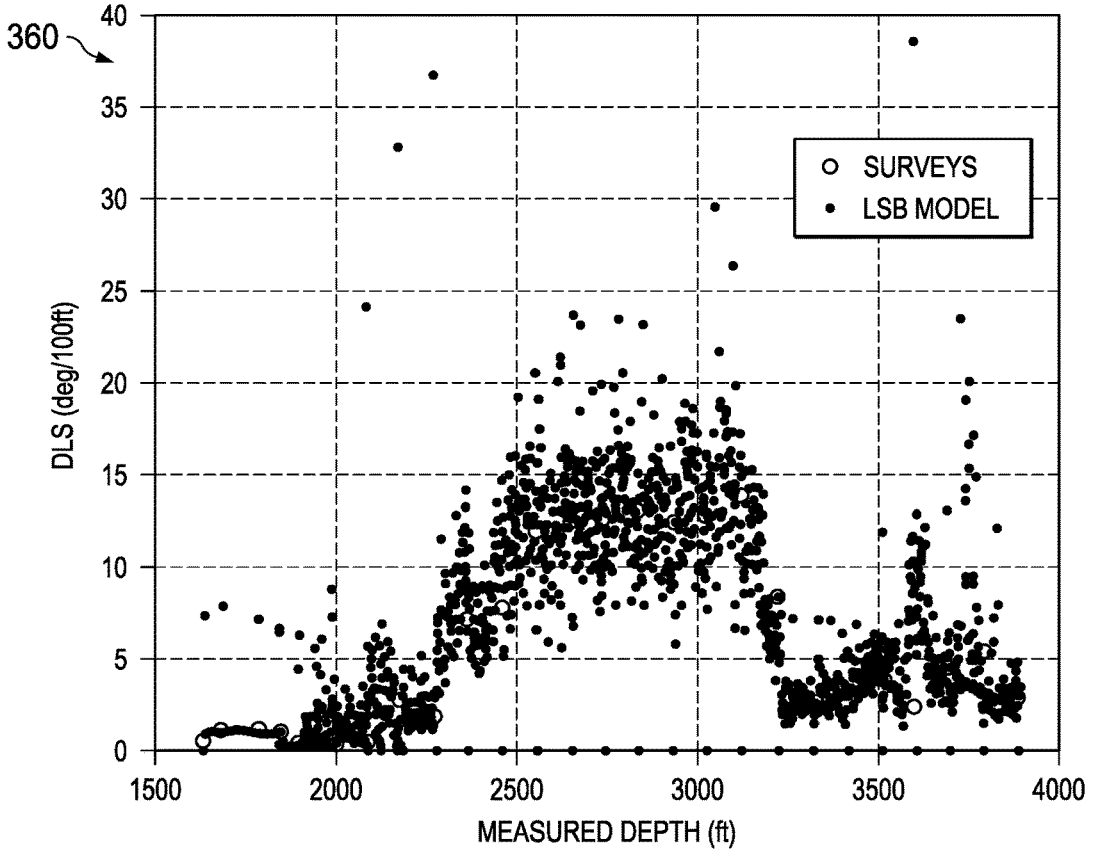
Figure 4:
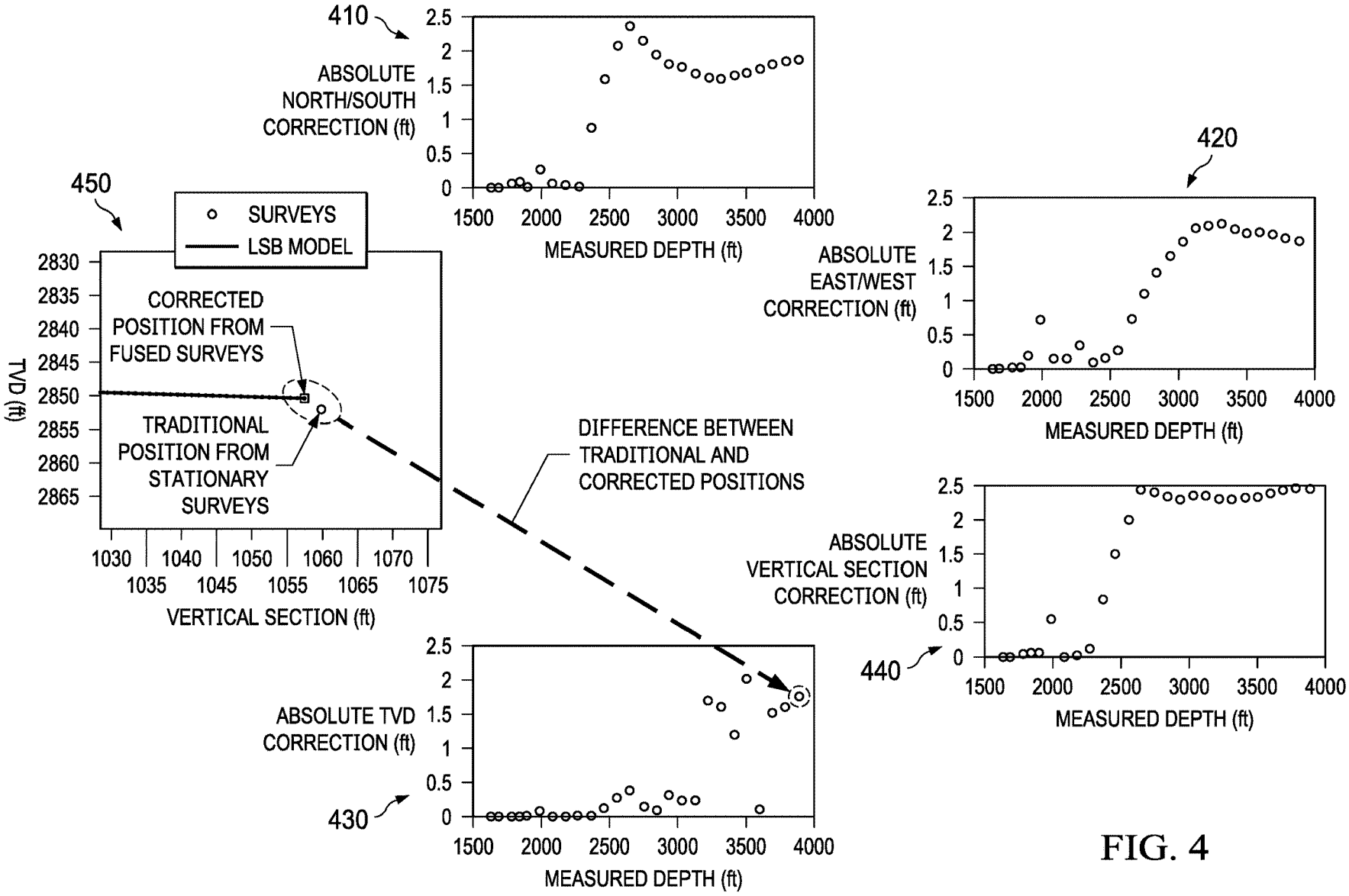
Figure 5:
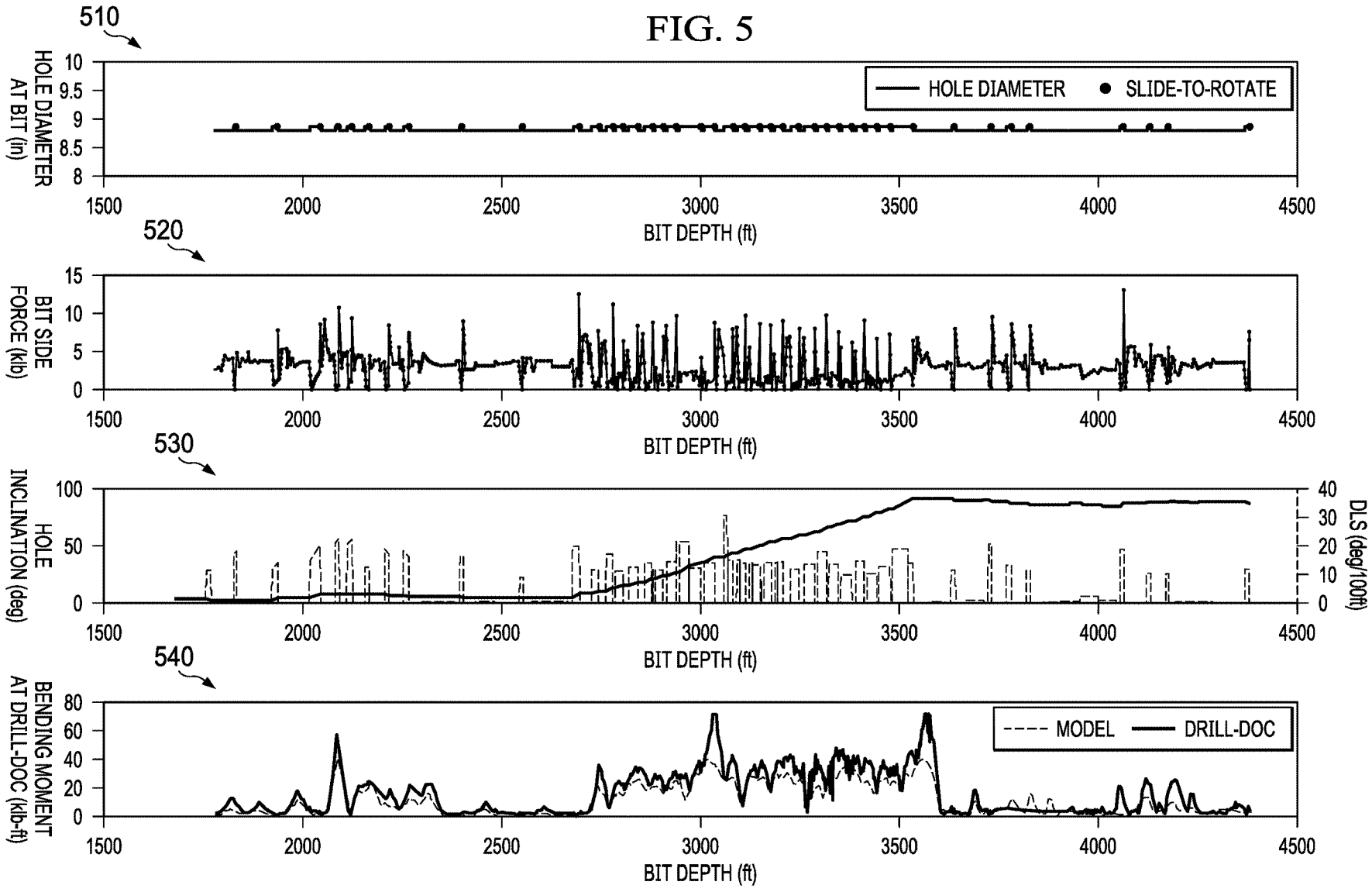
Figure 6:
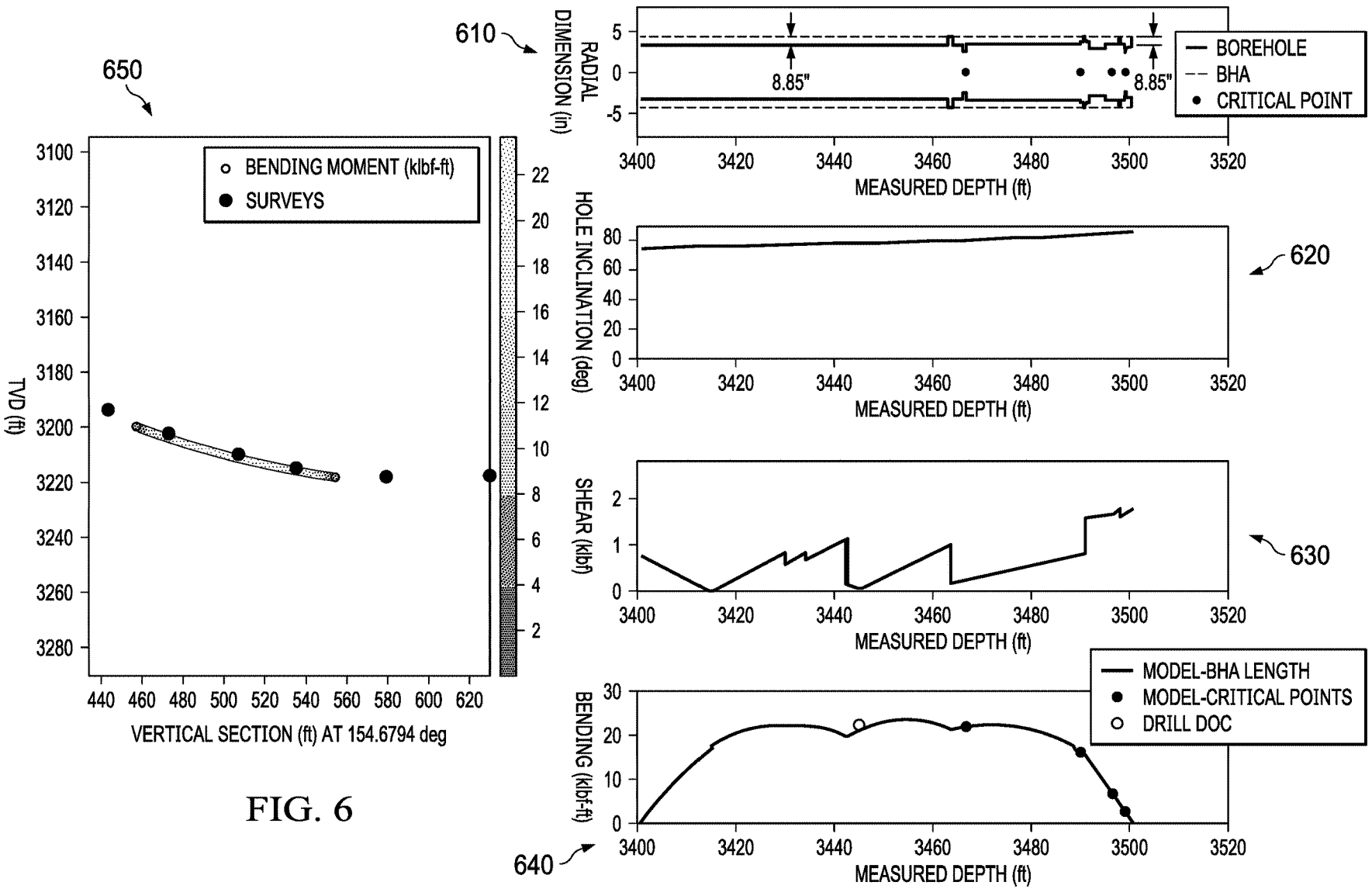
Figure 7:
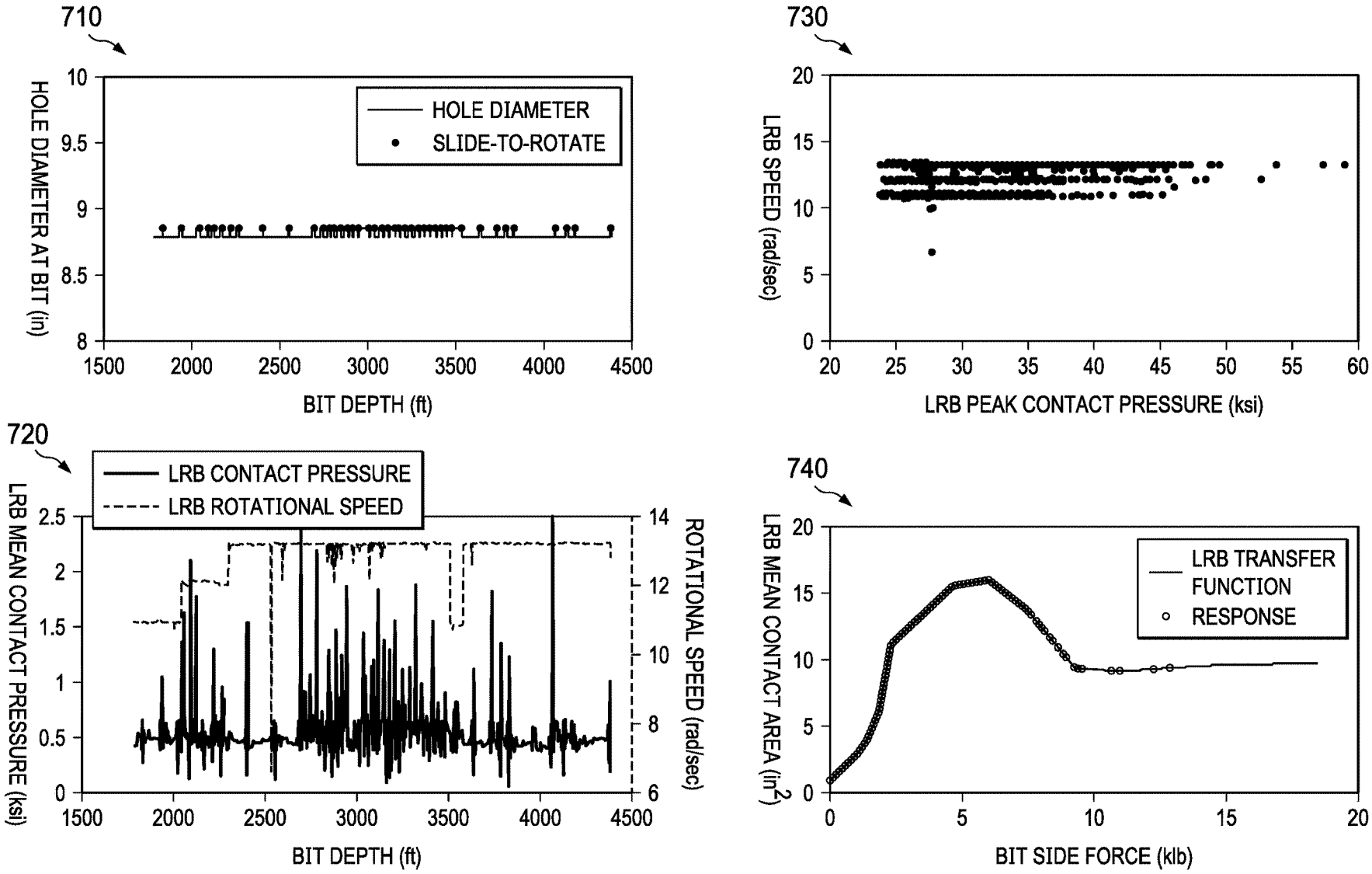
Figure 8:
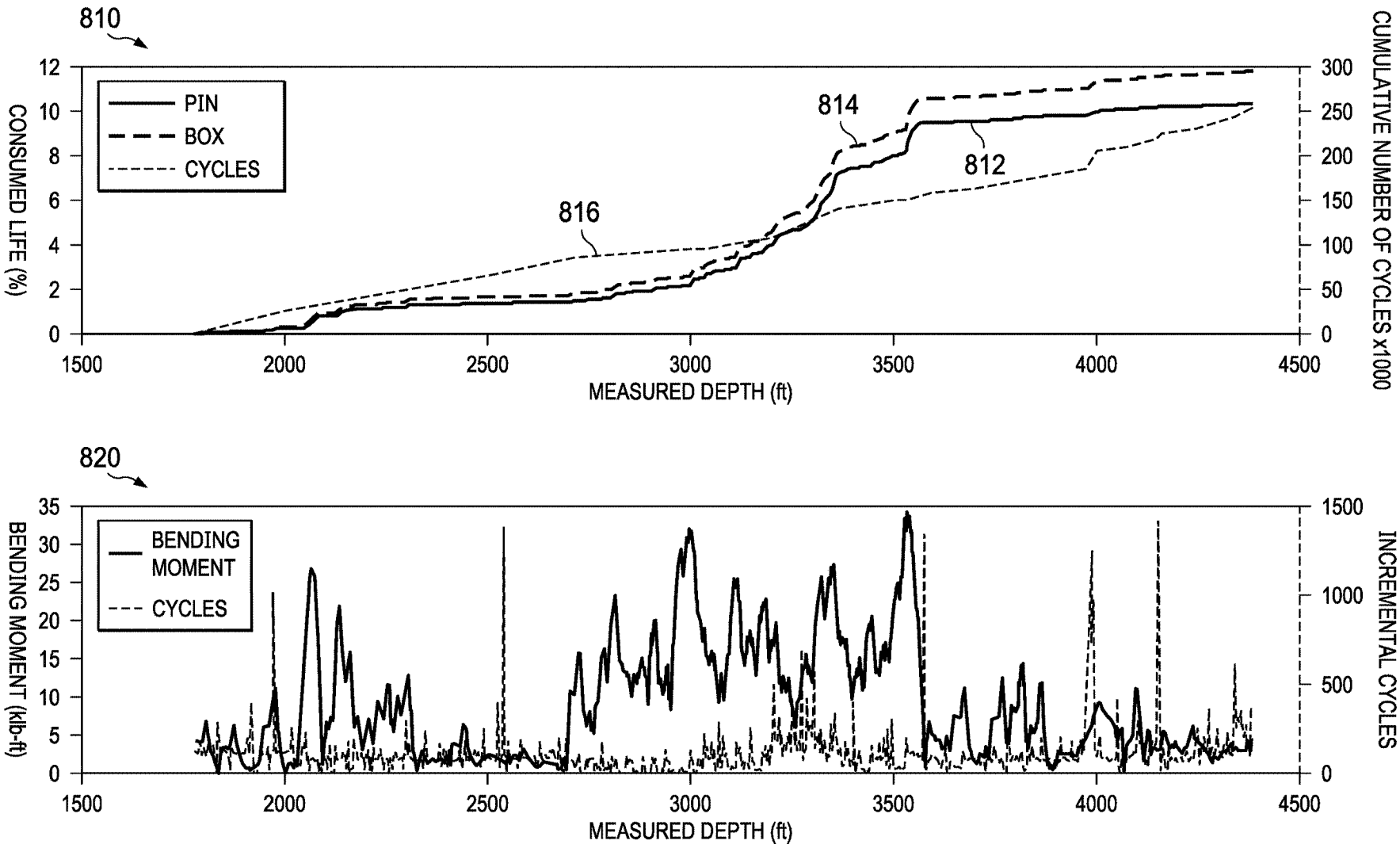
Figure 9A:
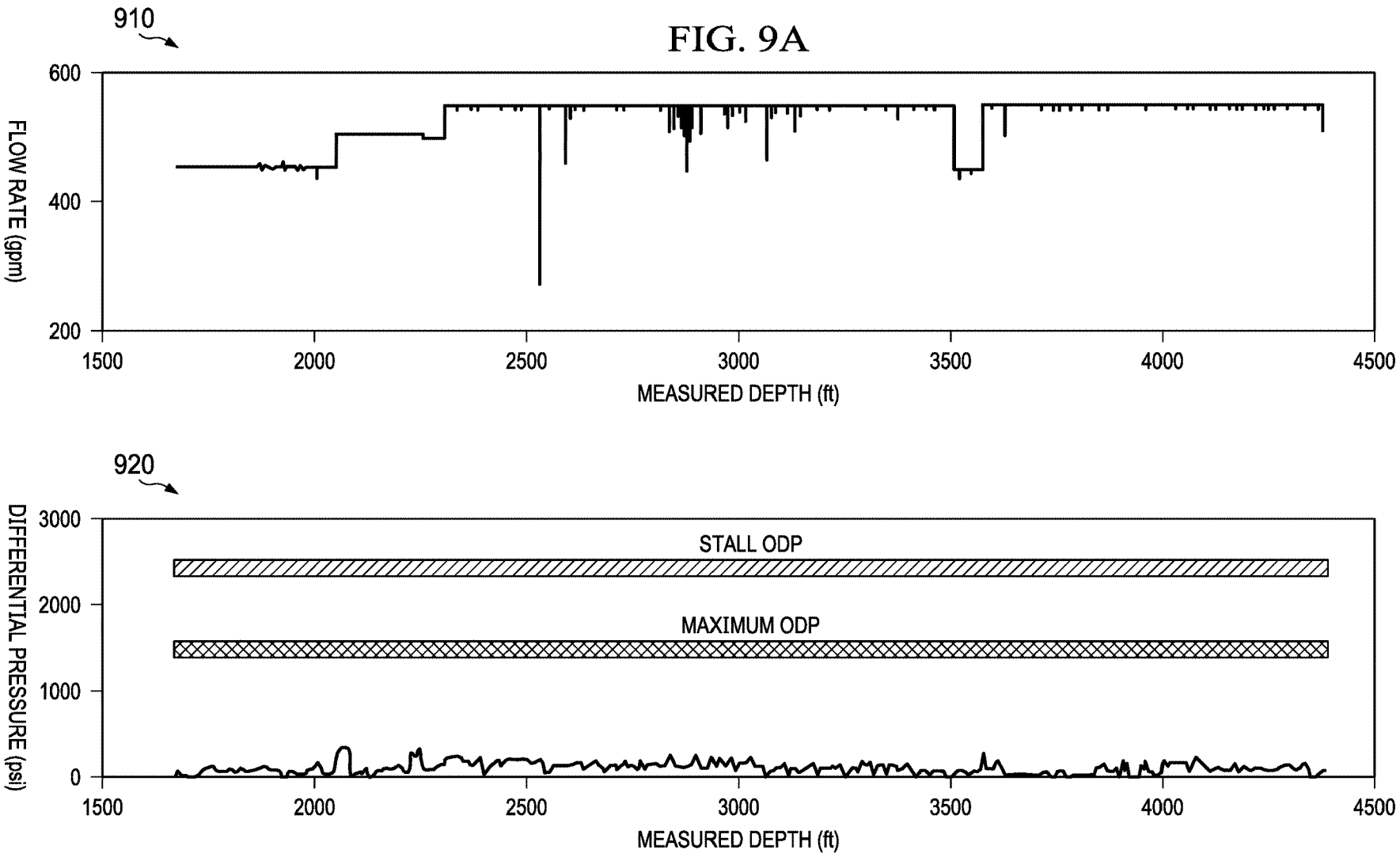
Figure 9B:
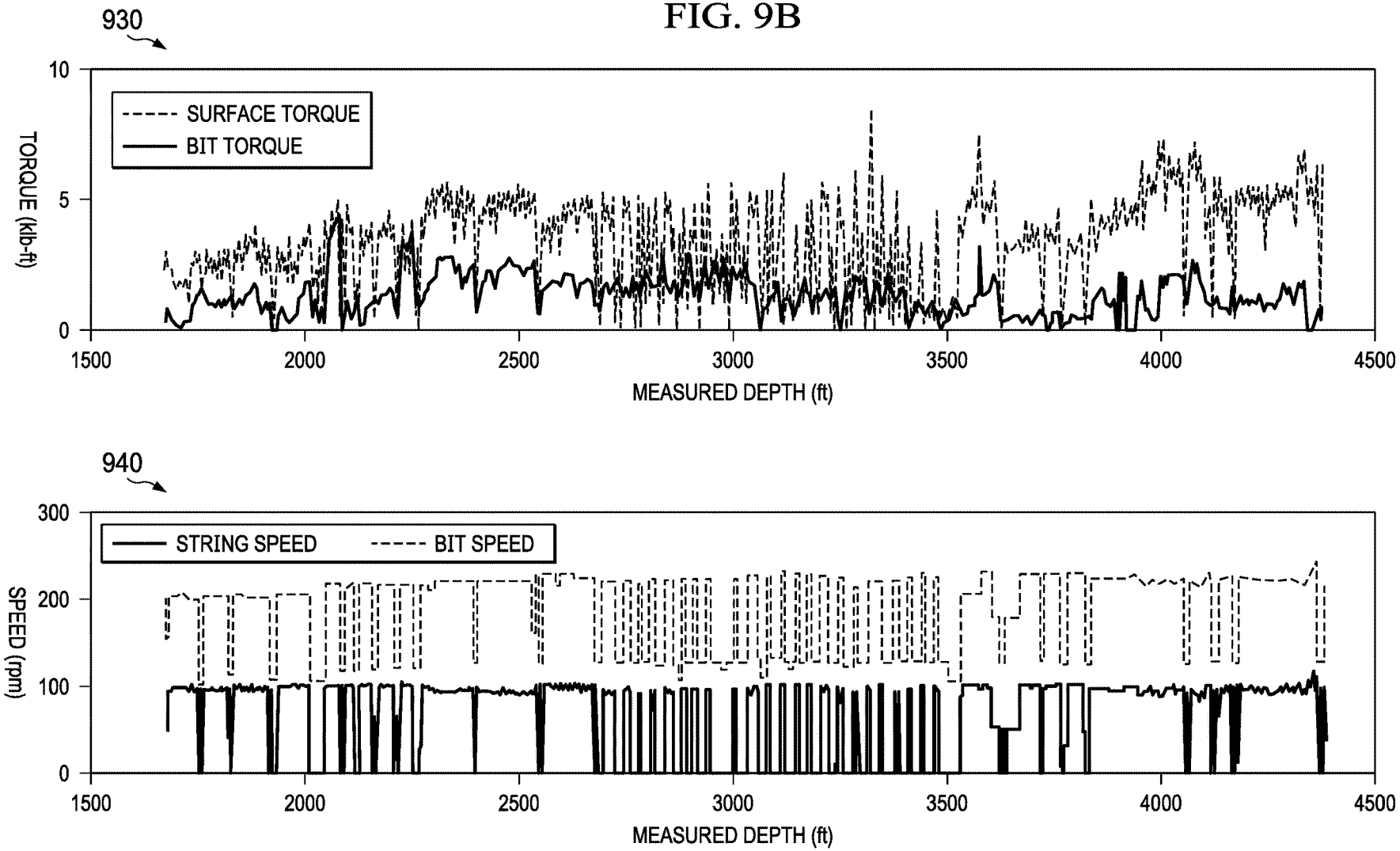
Figure 9C:
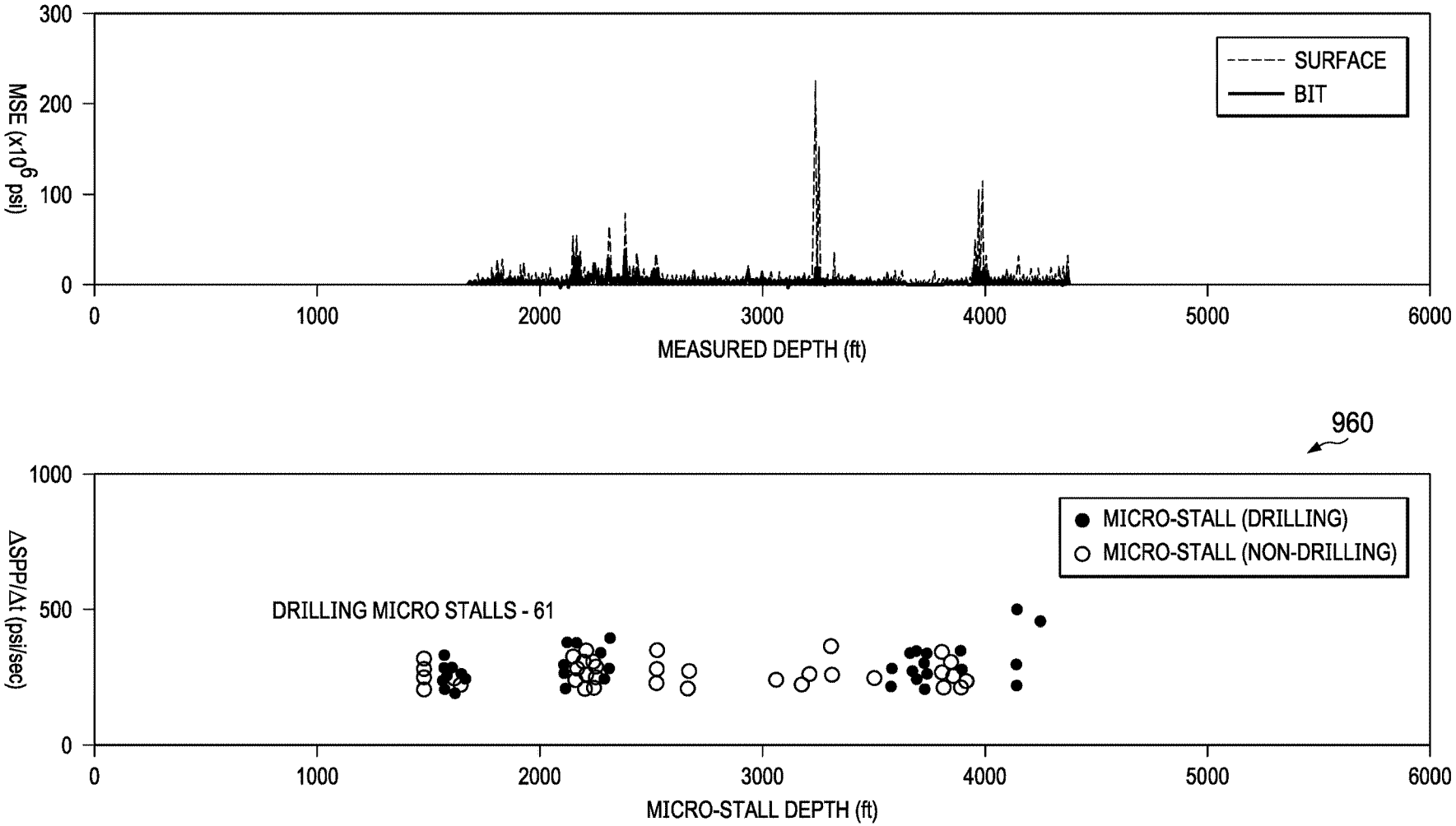
Figure 9D:
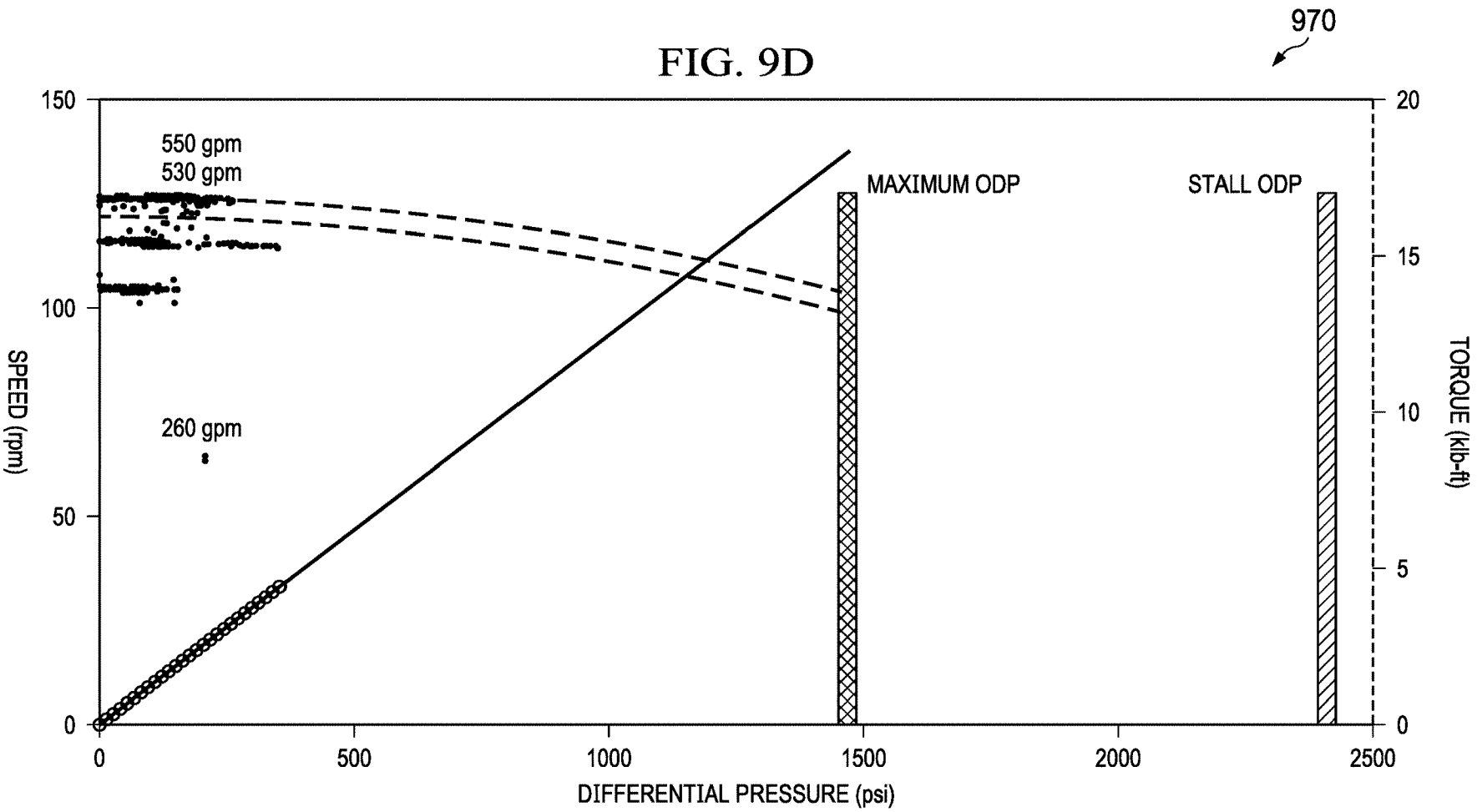
Figure 10:
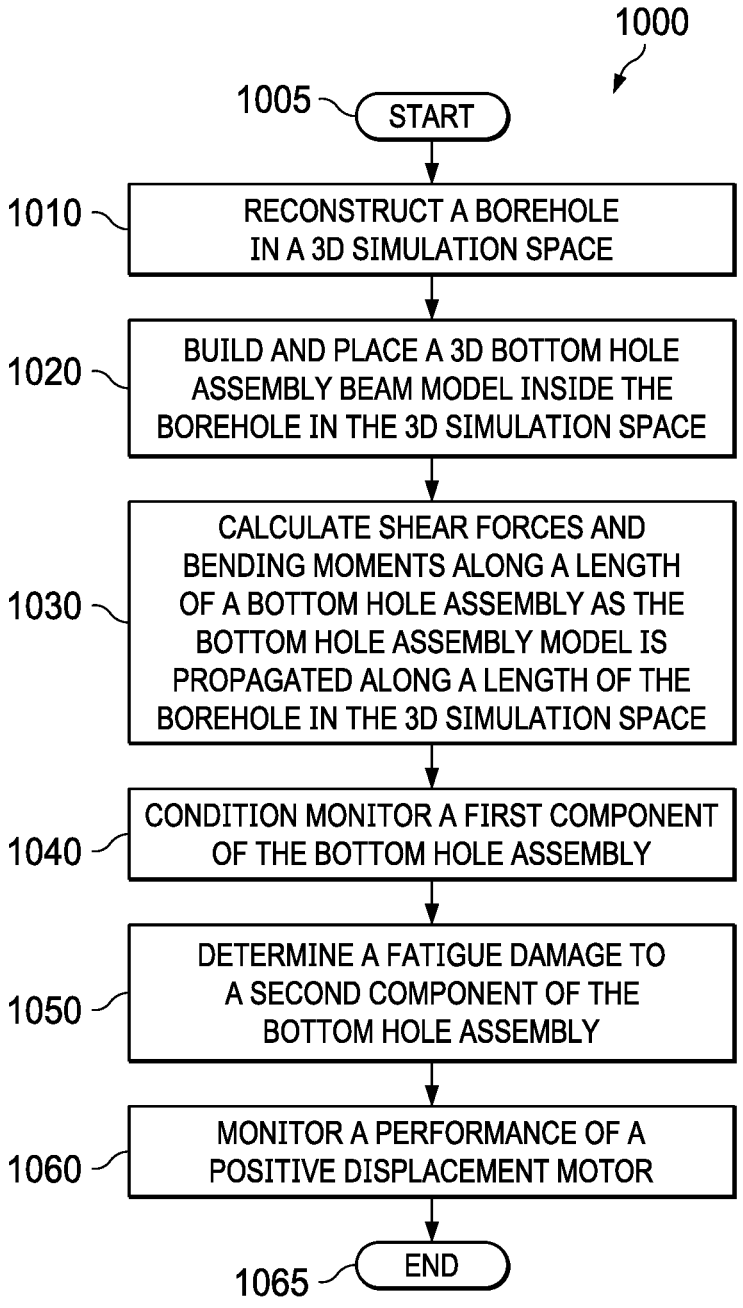

FIGS. 3A-C are exemplary outputs of the well positioning module implemented according to the principles of the disclosure;

FIG. 4 is another example output of the well positioning module implemented according to the principles of the disclosure;

FIG. 5 is an example output of the BHA propagation module implemented according to the principles of the disclosure;

FIG. 6 is another example output of the BHA propagation module implemented according to the principles of the disclosure;

FIG. 7 is an example output of the internal component monitoring module implemented according to the principles of the disclosure;

FIG. 8 is an example output of the cumulative damage monitoring module implemented according to the principles of the disclosure;

FIGS. 9A-D are exemplary outputs of the power section monitoring module implemented according to the principles of the disclosure; and FIG. 10 is a flow diagram of an embodiment of a method for monitoring structural health of a BHA carried out according to the principles of the disclosure.

DETAILED DESCRIPTION

Conventional practice for determining a life expectancy of a BHA has been based on simple static bending moment evaluation and/or conservative past experience life limits. This archaic practice has often led to premature scrapping of BHAs and has proven to be overly conservative and cost-ineffective. What is needed is a modernized system or method that can reliably track performance and life of drilling tools such that it not only avoids potential downhole failures but also maximizes asset utilization.

Introduced herein is a BHA condition monitoring technique that combines both field data and advanced models into one monitoring unit. The introduced technique is based on a combination of system and component level models that monitors and evaluates the current health and life of BHA components. The introduced technique can apply to all directional drilling BHAs, including mud motors and rotary steerable systems.

The introduced technique implements and uses five evaluation modules. The first module, a well-positioning module, reconstructed a borehole in a 3D simulation space by determining the borehole trajectory and diameter from field data. The second module, a BHA propagation module, analyzes the shear force and bending moment along the length of a BHA at multiple depth increments by propagating a 3D BHA beam model along the length of the reconstructed borehole in the 3D simulating space. The third and fourth modules, an internal component monitoring module and a cumulative damage monitoring module, relate the system level loads from the second module to the loads on specific tool components using local component-level models. The fifth (optional) module, a power section monitoring module, monitors torque/pressure/flow rate performance of a positive displacement motor and corresponding stalls/micro-stalls incidents.

The introduced technique can be used at different levels of the tool's life cycle to improve efficiency, reduce downhole failure incidents, and maximize assets' utilization, such as:

a. Tool design: analyze loads on new tools during the development phase to consider proper design changes;

b. Pre-Run Analysis: analyze loads for a given well-plan and steering commands to mitigate potential problems;

c. Real-Time Run Analysis: analyze loads in real-time to provide early warning of potential high loads that can fail the tool and provide a load history of the tool components;

d. Post-Run Analysis: analyze loads after a tool failure to identify areas of high loads.

Figure 1:
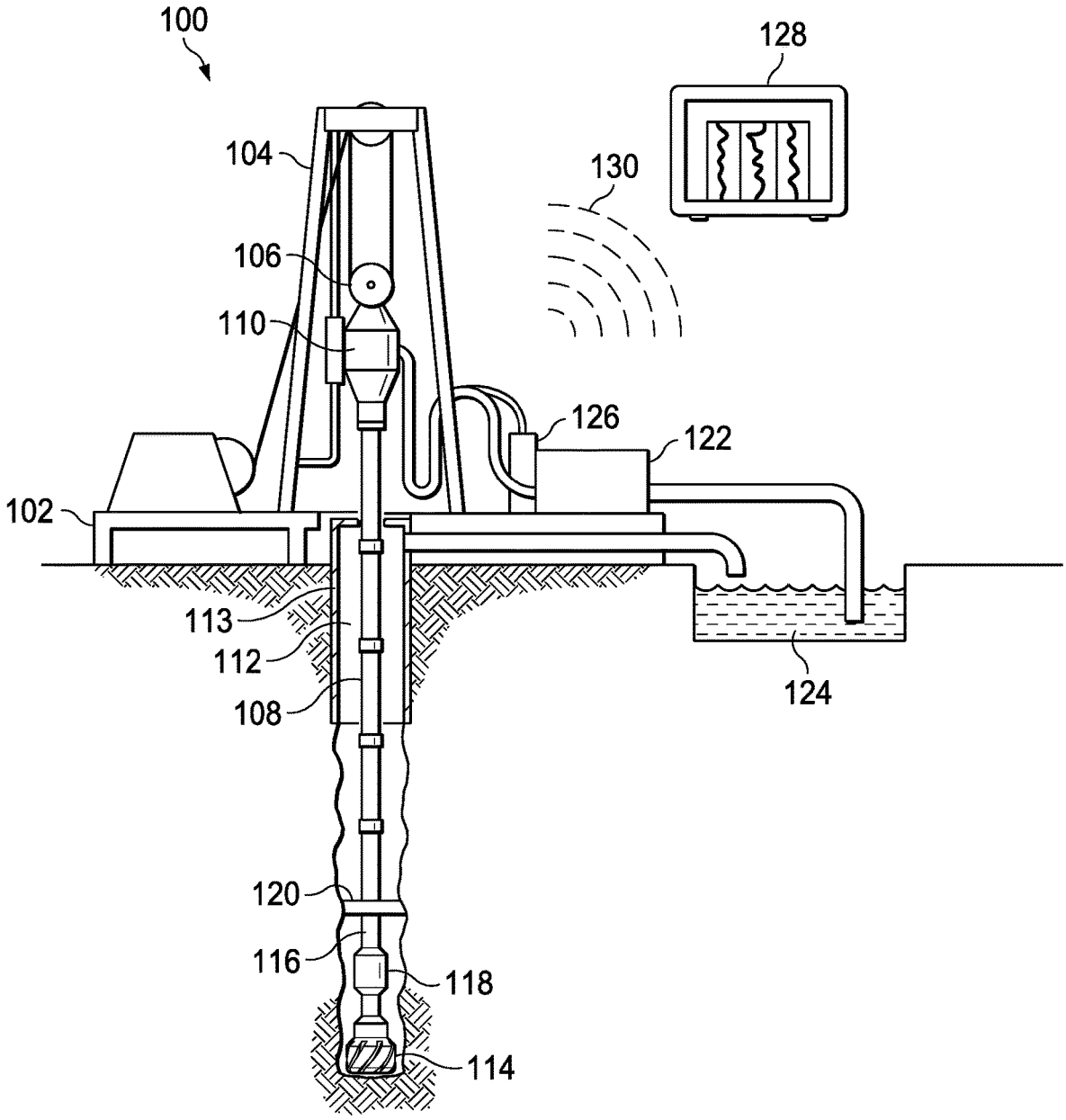
FIG. 1 is a schematic diagram of an illustrative drilling environment.

FIG. 1 is a schematic diagram of an illustrative drilling environment 100. The drilling environment 100 comprises a drilling platform 102 that supports a derrick 104 having a traveling block 106 for raising and lowering a drill string 108. A top-drive motor 110 supports and turns the drill string 108 as it is lowered into a borehole 112. The drill string's rotation, alone or in combination with the operation of a downhole motor, drives the drill bit 114 to extend the borehole 112. The drill bit 114 is one component of a BHA 116 that may further include a rotary steering system (RSS) 118 and stabilizer 120 (or some other form of steering assembly) along with drill collars and logging instruments. A pump 122 circulates drilling fluid through a feed pipe to the top drive 110, downhole through the interior of drill string 108, through orifices in the drill bit 114, back to the surface via an annulus around the drill string 108, and into a retention pit 124. The drilling fluid transports formation samples, e.g., drill cuttings, from the borehole 112 into the retention pit 124 and aids in maintaining the integrity of the borehole. Formation samples may be extracted from the drilling fluid at any suitable time and location, such as from the retention pit 124. The formation samples may then be analyzed at a suitable surface-level laboratory or other facility (not specifically shown). While drilling, an upper portion of the borehole 112 may be stabilized with a casing string 113 while a lower portion of the borehole 112 remains open (uncased).

The drill collars in the BHA 116 are typically thick-walled steel pipe sections that provide weight and rigidity for the drilling process. The thick walls are convenient sites for installing logging instruments that measure downhole conditions, various drilling parameters, and characteristics of the formations penetrated by the borehole. The BHA 116 typically further includes a navigation tool having instruments for measuring tool orientation, e.g., multi-component magnetometers and accelerometers, and a control sub with a telemetry transmitter and receiver. The control sub coordinates the operation of the various logging instruments, steering mechanisms, and drilling motors, in accordance with commands received from the surface, and provides a stream of telemetry data to the surface as needed to communicate relevant measurements and status information. A corresponding telemetry receiver and transmitter are located on or near the drilling platform 102 to complete the telemetry link. At least some of the data obtained by the control sub may be stored in memory for later retrieval, e.g., when the BHA 116 physically returns to the surface.

Figure 2:
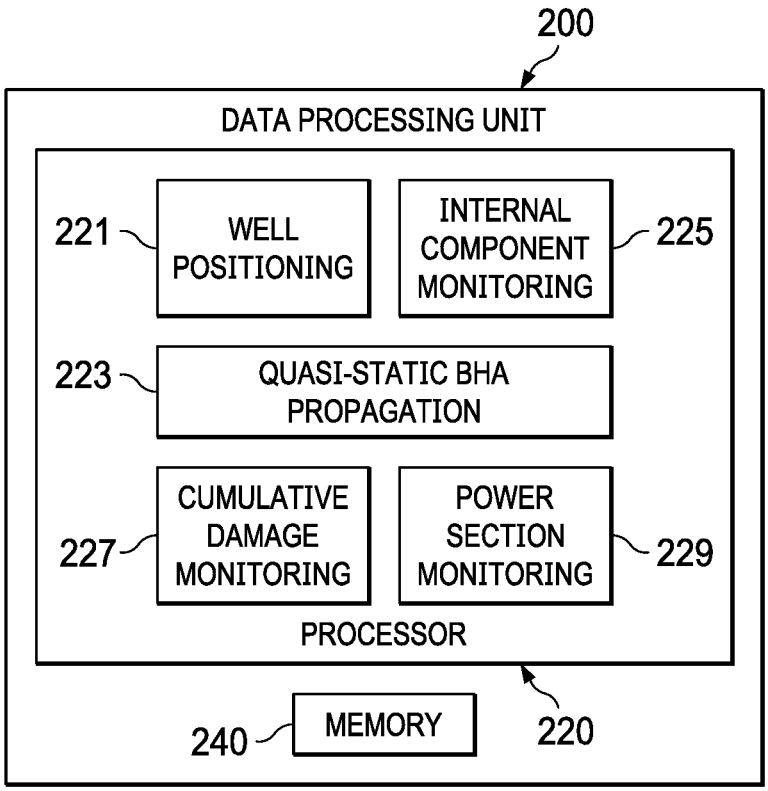
FIG. 2 is a block diagram of an embodiment of a data processing unit implemented according to the principles of the disclosure.

A surface interface 126 serves as a hub for communicating via the telemetry link and for communicating with the various sensors and control mechanisms on the platform 102. The surface interface 126 may include, for instance, a telemetry receiver (not specifically shown) to receive communications from a corresponding telemetry antenna in the control sub of the BHA 116. A data processing unit 128 (shown in FIG. 1 as a tablet computer) communicates with the surface interface 126 via a wired or wireless link 130, collecting and processing measurement data to generate logs and other visual representations of the acquired data and the derived models to monitor structural health of the BHA 116. FIG. 2 provides an example of such a data processing unit.

FIG. 2 illustrates a block diagram of an embodiment of a data processing unit 200 implemented according to the principles of the disclosure. The data processing unit 200 may be a local data processing unit located in or near the drilling environment, such as the data processing unit 128 in FIG. 1, or a remote data processing unit that is located remotely from the drilling environment. The data processing unit 200 may take many suitable forms, including one or more of: an embedded processor, a desktop computer, a laptop computer, a central processing facility, and a virtual computer in the cloud. For a real-time run analysis, the data processing unit 200 may be communicatively coupled to a BHA, such as the BHA 116 in FIG. 1, using mud pulse telemetry, electromagnetic telemetry, or any other suitable communication technique, to receive downhole measurements therefrom.

The data processing unit 200 includes a processor 220 and a memory 240, which are connected to one another using conventional means. The processor 220 is configured to implement multiple analysis modules using software stored in the memory 240 to monitor structural health of a BHA. The instructions of the software stored in memory 240 can, when executed, cause the processor 220 to implement the multiple analysis modules. The processor 220 may take many suitable forms, including one or more of: a central processing unit (CPU), a graphics processing unit (GPU), and a digital signal processor.

In addition to the software for implementing the analysis modules, the memory 220 is configured to store field data, e.g., surveys, live inclination/azimuth, and steering commands/duty cycles, and downhole sensor measurements (when available), e.g., shear force and bending moments. The memory 220 includes a non-transitory information storage medium and may take many suitable forms, including one or more of: static random-access memory (SRAM), dynamic random-access memory (DRAM), read-only memory (ROM), and flash memory.

In the illustrated embodiment, the processor 220 implements five analysis modules: a well positioning module 221, a BHA propagation module 223, an internal component monitoring module 225, a cumulative damage monitoring module 227, and a power section monitoring module 229. Working together, these analysis modules, 221, 223, 225, 227, 229 monitor structural health of a BHA.

In the illustrated embodiment, the well positioning module (WPM) 221 is configured to reconstruct a borehole in a 3D simulation space by determining a trajectory and diameter of the borehole along the drilling depth based on the field data. More specifically, the WPM 221 determines the trajectory of the borehole using borehole models that determine trajectories between surveys from duty cycles, live inclination/azimuth and surveys of the field data, and determines the diameter of the borehole along the drilling depth using a borehole over-gauge assumption that determines the diameter based on duty cycles and BHA geometry from the field data. The reconstructed borehole is not approximated using the conventional minimum curvature method. The WPM 221 is also configured to perform the position correction and the uncertainty analysis to correct the borehole's true vertical depth (TVD), latitude, longitude, and vertical section depth.

It is understood that the reconstructed borehole may be modeled after a borehole that is being drilled, e.g., for a real-time analysis, or a borehole that has already been drilled or will potentially be drilled.

The field data may include past or real-time field data acquired from data acquisition software, e.g., InSite® of Halliburton Energy Services of Houston, Tex., and/or look-ahead or virtual field data from a direction drilling advisor (DDA) or from a virtual well. The borehole models may include a duty cycle and survey to borehole (DSB) model, which is constructed using duty cycles and surveys from the field data, and live inclination/azimuth and survey to borehole (LSB) model, which is constructed using live inclination/azimuth data and surveys from the field data. Duty cycles are slide/rotate modes for mud motors, percentage bit direction for point-the-bit systems, or percentage pad force for push-the-bit systems; live inclination/azimuth is continuous inclination/azimuth direction of the borehole; and surveys are coarse/intermittent location measurements from a logging tool, e.g., measurement for every 30-90 feet of drilling, indicating respective location of the borehole in 3D space.

FIGS. 3A-C illustrates exemplary outputs of the WPM 221 implemented according to the principles of the disclosure. In the illustrated examples, circles represent surveys, dotted lines represent duty cycles and solid lines represent trajectories between the surveys calculated using a LSB model. FIG. 3A illustrates trajectories with respect to an inclination and measured depth in a first plot 310 and, trajectories with respect to azimuth and the measured depth in a second plot 320. FIG. 3B illustrates trajectories with respect to East/West and North/South in a third plot 330 and trajectories with respect to a TVD and a vertical section in a fourth plot 340. FIG. 3C illustrates trajectories with respect to the TVD, East/West and North/South in a fifth plot 350 and trajectories with respect to a dogleg severity (DLS) and the measured depth in a sixth plot 360.

FIG. 4 illustrates another example output of the WPM 221 implemented according to the principles of the disclosure. In the illustrated example, circles represent surveys and solid lines represent a LSB model. A first plot 410 shows an absolute North/South correction with respect to a measured depth. A second plot 420 shows an absolute East/West correction with respect to the measured depth. A third plot 430 shows an absolute TVD correction with respect to the measured depth, and a fourth plot 440 shows an absolute vertical section correction with respect to the measured depth. A TVD-vertical section plot 350 shows the difference between the traditional borehole position 360, which is derived from the surveys, to the true position, which is derived from trajectories determined by the WPM 221.

Referring back to the analysis modules in FIG. 2, the BHA propagation module (QBPM) 223 is configured to calculate shear forces and bending moments along a length of a BHA at each depth of the borehole by simulating a propagation of the BHA along the length of the borehole in the 3D simulation space. More specifically, the QBPM 223 first builds a 3D BHA model for a BHA and places the 3D BHA model inside the reconstructed borehole. The QBPM 223 then propagates the BHA model through the length of the borehole, and calculates shear force and bending moments at each critical point along a length of the BHA using the BHA model. The QBPM 223 can use the field data, such as the BHA geometries/general dimensions and operational parameters of the BHA, and calculated values such as the borehole diameters and trajectories from the WPM 221.

In addition to the shear forces and bending moments, the QBPM 223 can calculate bit side force, curve-tangent transition and intensity and stabilizer's side force and drag for more comprehensive calculation. Also when the downhole measurements are available, the QBPM 223 can calibrate the BHA model based on the comparison between the calculated values and the downhole sensor measurements. The downhole sensor measurements of the shear forces and bending moments may be acquired using a drilling optimization tool such as DrillDOC® of Halliburton Energy Services of Houston, Tex.

It is understood that the BHA model is modeled after a physical BHA that is being used for drilling, e.g., for a real-time analysis, or a BHA that has been used or will potentially be used for drilling.

FIG. 5 illustrates an example output of the QBPM 223 implemented according to the principles of the disclosure. In the illustrated example, a first plot 510 shows how a hole diameter at the bit varies as the bit propagates through a portion of a borehole. A second plot 520 shows how a bit side force varies as the bit propagates through the portion of the borehole. A third plot 530 shows how a calculated DLS corresponds to a hole inclination as the bit propagates through the portion of the borehole, and a fourth plot 540 shows how a calculated bending moments compare to sensor measurements DrillDoc® as the bit propagates through the portion of the borehole.

FIG. 6 illustrates another example output of the QBPM 223 implemented according to the principles of the disclosure. Plots 610, 620, 630, 640 on the right show how a radial dimension, hole inclination, shear force, and bending moments change as a bit depth reaches 3500 feet, respectively. In the first plot 610, dashed (magenta) line represents a borehole diameter, solid line represents the BHA diameter, and circle represents critical points along a BHA. The fourth plot 640 shows calculated bending moments at the critical points along the length of the BHA with respect to sensor measurements from DrillDoc®. The fourth plot 640 can be for the aforementioned calibration. The fifth plot 650 on the left shows how the bending moments change as the bit depth reaches 3500 ft. In the fifth plot 650, circles represent survey values from a measurement tool, e.g., a drilling while drilling (MWD) tool, indicating a borehole trajectory Referring back again to the analysis modules in FIG. 2, the internal component monitoring module (ICMM) 225 and the cumulative damage monitoring module (CDMM) 227 are configured to condition-monitor the BHA, e.g., monitor a parameter of a condition in the BHA to identify a significant change which is indicative of a developing failure.

The ICMM 225 is configured to condition-monitor internal components of the BHA. More specifically, the ICMM 225 relates the external or system-level shear forces and bending moments, e.g., the shear forces and bending moments calculated by the QBPM 223, to loads internally exerted on a particular internal component using a local transfer function model, e.g., a finite element analysis (FEA) model, of the particular internal component. The ICMM 225 then compares the determined internal loads to the load limit, e.g., a Pressure-Velocity limit, of the internal component and provide an early warning of potentially high loads or possible failure of the particular internal component. The local transfer function model/FEA model may be provided from a design specification of BHA. For example, a local transfer function model for a driveshaft of a mud motor for a drilling tool may be provided from the manufacturer's specification of the drilling tool design.

It is understood that the ICMM 225 may be further configured to provide a warning that the monitored component is experiencing a load that is close its load threshold, e.g., 80-90% of the load limit. The warning may be provided to a user of the data processing system 200 and also to an operator of the rig if the data processing unit 200 is being used for real-time run analysis.

FIG. 7 illustrates an example output of the ICMM 225 implemented according to the principles of the disclosure. A lower radial bearing of a BHA is condition-monitored in FIG. 7. A first plot 710 shows how a hole diameter at bit (solid line) varies at each Slide-to-Rotate (circle), which is a transition in duty cycle, as a bit depth varies. A second plot 720 shows how a contact pressure corresponds to a rotational speed as the bit depth varies. A third plot 730 shows the bearing rotational speed and a peak contact pressure at various loading incidents at the bearing. The rotational speed in the third and fourth plots 730, 740 may be measured from a bit rotational speed sensor in a tool like a rotary steerable system (RSS) or calculated from performance curves of a mud motor (see, e.g., 970 in FIG. 9). From the third plot 730, the aforementioned PV limit can be established through lab testing. Once the limit is established, the third plot 730 can be used to monitor whether the PV at the bearing is approaching its limit. A fourth plot 740 shows how the lower radial bearing's contact area relates to a bit side force. Solid lines represent a local transfer function model of the lower radial bearing, and circles represent load instances at different drilling depths increments. The circles are the accumulation of instances to show their distribution along a range of the local transfer function.

The CDMM 227 of the data processing unit 200 is configured to determine fatigue damages to the components of the BHA. More specifically, the CDMM 227 determines fatigue damage to a particular component of a BHA by accumulating operation cycles and loads that the particular component has endured during the operation, e.g., the propagation/drilling, and calculating a consumed life of the particular component—how much of the particular component's life span has been consumed—based on the accumulated operation cycles and loads.

Based on component loading physics of the particular component, the CDMM 227 may use a specific local fatigue model/transfer function to calculate a consumed life of the particular component. For example, a consumed life of a housing, e.g., a tubular in the BHA, connection can be calculated using a strain-life based model that relates applied cyclic bending on the connection, and a consumed life of a uniform cross-section of a housing can be calculated using a stress-life based model.

The operation cycles can be accumulated from the field data/measurements, and the loads can be accumulated from the shear force and bending moments calculated by the QBPM 223. For some components, such as an elastomer in a positive displacement motor (PDM), the loads can be provided from an accumulation of detected micro-stall incidents. The local fatigue models can be provided from a design specification of BHA. In addition to housing connections and a cross section of a housing, the CDMM 227 can determine fatigue damages for external components such as subs and other critical points in the housing, and internal components such as driveshafts.

It is understood that the CDMM 227 may be further configured to provide a warning that the consumed life of the monitored component has exceeded the consumed life threshold, e.g., 80-90% based on the consumed life calculation. The warning may be provided to a user of the data processing system 200 and also to an operator of the rig if the data processing unit 200 is being used for real-time run analysis.

FIG. 8 shows an example output of the CDMM 227 implemented according to the principles of the disclosure. An upper stator connection of a BHA is monitored for fatigue damage in FIG. 8. A first plot 810 shows how a consumed life of the upper stator connection changes across a portion of a borehole length. A first solid line 812 represents a consumed life of a pin of the upper stator connection, a second solid line 814 represents a consumed life of a box in the upper stator connection, and a third dashed line 816 represents a cumulated number of cycles. A second plot 820 shows accumulations of bending moments and cycles across the portion of the borehole length.

Referring back yet again to the analysis modules in the data processing unit 200, the power section monitoring module (PSMM) 229 is configured to monitor a performance of a PDM, such as a mud motor of a BHA. The PSMM 229 monitors a performance of a PDM by tracking performance parameters of the PDM and evaluating a downhole torque and a differential pressure at the PDM based on the tracked performance parameters and performance functions. For example, the PSMM 229 can evaluate the efficiency of the PDM based on the mechanical specific energy, and identify stall and micro-stall incidents based on Max and Stall operational differential pressures (ODPs) and changes in stand pipe pressure over time increments. As mentioned above, an accumulation of micro-stall incidents may be correlated to the PDM elastomer fatigue life.

The performance parameters may be derived from the field data, and include parameters, such as surface flow rate, stand pipe pressure, weight-on-bit, torque-on-bit and downhole bit speed. The performance function is a local transfer function model that can be obtained from the vendor specification of the PDM. It is understood that the PSMM 229 may be further configured to provide a warning that the monitored PDM is performing below threshold efficiency or close to a level, e.g., 80-90% of the max/stall ODP, which would stall the operation. The warning may be provided to a user of the data processing system 200 and also to an operator of the rig if the data processing unit 200 is being used for real-time run analysis. It is understood that for a BHA that does not include a PDM, the PSMM 229 may be omitted.

FIGS. 9A-D illustrate exemplary outputs of the PSMM 229 implemented according to the principles of the disclosure. A first plot 910 in FIG. 9A shows a measured flow rate of the fluid, e.g., mud through a mud motor of a BHA, along a portion of a borehole length. A second plot 920 in FIG. 9A shows a calculated differential pressure across the mud motor along the portion of the borehole length. The second plot 920 has Stall ODP, a differential pressure at which the BHA stalls, and a max ODP, a maximum operational differential pressure of the BHA. The mud motor is monitored so that the differential pressure of the BHA does not exceed the stall or max ODP. A third plot 930 in FIG. 9B shows a measured surface torque (dashed line) and a calculated bit torque (solid line) across the portion of the borehole length. A fourth plot 940 in FIG. 9B shows a calculated bit speed (dashed line) and a measured string/surface speed (solid line) across the portion of the borehole length. A fifth plot 950 in FIG. 9C shows calculated mechanical specific energy, which is an indicator of drilling efficiency, across the borehole length. A sixth plot 960 in FIG. 9C shows micro-stall incidents, which are temporary stalling, e.g., one or two seconds, of the motor across the borehole length. The micro-stalls are identified as a function of the change in stand pipe pressure (SPP) over a time increment. A seventh plot 970 in FIG. 9D is a performance curve tracking a performance of the mud motor. Dashed lines are based on performance functions from the vendor of the mud motor at specific flow rates, while blue dots are the accumulation of instances at actual differential pressures and flow rates.

FIG. 10 illustrates an embodiment of a flow diagram of a method 1000 for monitoring structural health of a BHA carried out according to the principles of the disclosure. The method 1000 may be performed using a data processing unit, such as the data processing unit 200 in FIG. 2. The method 1000 starts at step 1005.

At step 1010, a borehole is reconstructed in a 3D simulation space by determining a trajectory and diameter of the borehole along the drilling depth based on field data. The step 1010 includes determining the trajectory of the borehole using borehole models that determine trajectories between surveys from duty cycles, live inclination/azimuth and surveys of the field data, and determining the diameter of the borehole along the drilling depth using a borehole overgauge assumption that determines the diameter based on duty cycles and BHA geometry from the field data. The field data may include past field data acquired from data acquisition software, and/or look-ahead or virtual field data from a direction drilling advisor (DDA) or a virtual well. The reconstructed borehole is not approximated using the conventional minimum curvature method. The step 1010 may also include performing an uncertainty analysis and correcting the position of the reconstructed borehole, such as correcting the borehole's true vertical depth (TVD), latitude longitude, and vertical section depth. The step 1010 may be performed using a well positioning module that is implemented by the data processing unit, such as the WPM 221 in FIG. 2.

As disclosed above, the borehole models that may be used for the step 1010 include a duty cycle and survey to borehole (DSB) model and live inclination/azimuth and survey to borehole (LSB) model. The borehole over-gauge assumption is a constraint that determines how a diameter of a borehole changes based on duty cycles and tool geometries.

At the step 1020, a 3D BHA model for a BHA is built using the field data, such as geometries/general dimensions of the BHA and operational parameters of the BHA, and placed inside the reconstructed borehole in the 3D simulation space. The step 1020 may be performed using a BHA propagation module such as the QBPM 221 in FIG. 2 that is implemented by the data processing unit.

At step 1030, shear forces and bending moments along a length of the BHA at each depth of the borehole are calculated by simulating a propagation of the BHA inside the borehole in the 3D space. The step 1030 includes propagating the BHA model through the length of the borehole, and as the BHA model propagates, calculating shear force and bending moments at each critical point along a length of the BHA at each increment of the drilling depth/borehole length. In addition to the shear forces and bending moments, the bit side force, curve-tangent transition and intensity and stabilizer's side force and drag are also calculated. The step 1030 may be performed using the BHA propagation module that performed the step 1020.

In one embodiment, values calculated at the step 1030 are compared to the downhole sensor measurements in real-time, and the BHA model is calibrate based on the comparison. In such an embodiment, the downhole sensor measurements of the shear forces and bending moments may be acquired from a drilling optimization tool such as Drill-DOC®.

At step 1040, internal components of the BHA are condition monitored. The step 1050 includes relating the external or system-level shear forces and bending moments, e.g., the shear forces and bending moments calculated at the step 1040, to loads applied to a particular internal component using a pre-defined local transfer function model, e.g., a FEA model, of the particular internal component, and comparing the load to the load limit, e.g., a Pressure-Velocity (PV) limit, of the particular internal component.

The pre-defined local transfer function model/FEA model may be provided from a design specification of BHA. For example, a local transfer function model for a driveshaft of a mud motor for a Sperry drilling tool would be provided from the specification of Sperry tool design. The step 1050 may be performed by an ICMM, such as the ICMM 225 in FIG. 2 that is implemented by the data processing unit to condition-monitor internal components, such as a bearing and a driveshaft of a BHA.

It is understood the step 1040 may include providing a warning that the monitored component is experiencing a load that is close the load threshold, e.g., 80-90% of the load limit. The warning may be provided to a user of the data processing system that performs the method 1000 and also to an operator of the rig when the method 1000 is being used for real-time run analysis.

At step 1050, fatigue damages to components of the BHA are determined. The step 1060 includes accumulating operation cycles and loads that a particular component has endured during the operation, e.g., the propagation, and calculating a consumed life of the particular component—how much of the particular component's life span has been consumed—based on the accumulated operation cycles and loads. Based on component loading physics of the particular component, a specific local fatigue model/transfer function may be used for the consumed life calculation.

The operation cycles can be accumulated from the field data/measurements, and the loads can be accumulated from the shear forces and bending moments calculated at the step 1040. The local fatigue models can be provided from a design specification of BHA. The step 1060 may be performed by a CDMM, such as the CDMM 227 in FIG. 2 that is implemented by the data processing unit to condition-monitor external components such as housing connections, subs and other critical points in the housing, and internal components such as driveshafts.

It is understood that the step 1050 may include providing a warning that the consumed life of the monitored component has exceeded the consumed life threshold, e.g., 80-90%. The warning may be provided to a user of the data processing system that performs the method 1000 and also to an operator of the rig when the method 1000 is being used for real-time run analysis.

At step 1060, a performance of a positive displacement motor (PDM) of the BHA, such as a mud motor of a BHA, is monitored. The step 1070 includes tracking performance parameters of the PDM and evaluating a downhole torque and a differential pressure at the PDM based on performance functions and the tracked performance parameters. For example, the step 1060 can evaluate the efficiency of the PDM based on the mechanical specific energy, and identify stall and micro-stall incidents based on Max and Stall ODPs and changes in stand pipe pressure over time increments.

The performance parameters include parameters, such as surface flow rate, stand pipe pressure, weight-on-bit, torque-on-bit and downhole bit speed that may be derived from the field data. The performance function may be a local transfer function model that may be provided by the vendor of the PDM. The step 1070 may be performed by a PSMM, such as the PSMM 229 in FIG. 2 that is implemented by the data processing unit.

It is understood the step 1060 may include providing a warning that the monitored PDM is performing below threshold efficiency or close to a level, e.g., 80-90% of the max/stall ODP, which would stall the operation. The warning may be provided to a user of the data processing system that performs the method 1000 and also to an operator of the rig when the method 1000 is being used for real-time run analysis.

In one embodiment where the method 1000 is being used for real-time run analysis, the method 1000 may include a step of retrieving the physical BHA based on the results/outputs of the steps 1040-1060 for a repair or a replacement. The method 1000 ends at step 1065.

A portion of the above-described apparatus, systems or methods may be embodied in or performed by various digital data processors or computers, wherein the computers are programmed or store executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Aspects disclosed herein include:

A. A data processing system for monitoring structural health of a bottom hole assembly (BHA) operating within a borehole, comprising: a memory; a processor communicatively coupled to the memory, the processor configured to implement, using instructions stored in the memory: a well-positioning module that reconstructs a borehole in a 3D simulation space using at least one borehole model that determines a trajectory of the borehole; a BHA propagation module that calculates shear forces and bending moments along a length of a BHA along a length of the borehole by simulating a propagation of the BHA along the length of the borehole in the 3D simulation space; and an internal component monitoring module that condition-monitors a first component of the BHA by relating the shear forces and bending moments to loads internally exerted on the first component.

B. A method for monitoring structural health of a bottom hole assembly (BHA) operating within a borehole, comprising: reconstructing a borehole in a 3D simulation space using at least one borehole model that determines a trajectory the borehole from field data; calculating shear forces and bending moments along a length of a BHA along a length of the borehole by simulating a propagation of the BHA along the length of the borehole in the 3D simulation space; and condition-monitoring components of the BHA, the condition-monitoring includes condition-monitoring a first component of the components by relating the shear forces and bending moments to loads internally exerted on the first component.

Each of aspects A and B can have one or more of the following additional elements in combination. Element 1: wherein the borehole is reconstructed using a borehole over-gauge assumption that determines a diameter of the borehole along the length of the borehole. Element 2: the simulating includes building and placing a 3D BHA model inside the borehole and propagating the 3D BHA model along the length of the borehole. Element 3: wherein the relating includes using a transfer function model for the first component to relate the shear forces and bending moments to the loads internally exerted on the first component. Element 4: wherein the processor is further configured to implement, using the instructions stored in the memory, a cumulative damage monitoring module that determines a fatigue damage to a second component of the BHA. Element 5: wherein the fatigue damage is determined by accumulating loads and operation cycles the second component has endured during the propagation and calculating a consumed life of the component based on the loads and operation cycles the second component has endured. Element 6: wherein the loads that the second component has endured are accumulated from the shear forces and bending moments. Element 7: the processor is further configured to implement, using the instructions stored in the memory, a power section monitoring module that monitors a performance of a positive displacement motor (PDM) of the BHA. Element 8: wherein the performance is monitored by tracking performance parameters of the PDM and evaluating a downhole torque and a differential pressure at the PDM using performance functions and the performance parameters of the BHA. Element 9: wherein the performance parameters include at least one of: a surface flow rate, a stand pipe pressure, a weight-on-bit, a torque-on-bit and a downhole bit speed. Element 10: wherein the condition-monitoring the components of the BHA includes determining a fatigue damage to a second component of the BHA. Element 11: further comprising monitoring a performance of a positive displacement motor (PDM) of the BHA.

What is claimed is:

1. A data processing system for monitoring structural health of a bottom hole assembly (BHA) operating within a borehole, comprising:

a downhole sensor that makes shear force and bending moment measurements;

a memory; and a processor communicatively coupled to said memory, said processor performs, by executing instructions stored in said memory, operations that include:

reconstructing a borehole in a 3D simulation space using at least one borehole model that determines a trajectory of said borehole;

calculating shear forces and bending moments along a length of a BHA along a length of said borehole by simulating a propagation of said BHA along said length of said borehole in said 3D simulation space;

calibrating said propagation based on a comparison between said shear forces and bending moments and said shear force and bending moment measurements; and condition-monitoring a first component of said BHA by relating said shear forces and bending moments to loads internally exerted on said first component; and providing a warning to a user when a consumed life of said first component exceeds a consumed life threshold for said first component.

2. The system of claim 1, wherein said borehole is reconstructed using a borehole over-gauge assumption that determines a diameter of said borehole along said length of the said borehole.

3. The system of claim 1, wherein said simulating a propagation of said BHA includes building and placing a 3D BHA model inside said borehole and propagating said 3D BHA model along said length of said borehole.

4. The system of claim 1, wherein said relating includes using a transfer function model for said first component to relate said shear forces and bending moments to said loads internally exerted on said first component.

5. The system of claim 1, wherein said operations further include determining a fatigue damage to said first component of said BHA.

6. The system of claim 5, wherein said fatigue damage is determined by accumulating loads and operation cycles said first component has endured during said propagation and calculating said consumed life of said first component based on said loads and operation cycles said second component has endured.

7. The system of claim 6, wherein said loads that said first component has endured are accumulated from said shear forces and bending moments.

8. The system of claim 1, wherein said operations further include monitoring a performance of a positive displacement motor (PDM) of said BHA.

9. The system of claim 8, wherein said performance is monitored by tracking performance parameters of said PDM and evaluating a downhole torque and a differential pressure at said PDM using performance functions and said performance parameters of said BHA.

10. The system of claim 9, wherein said performance parameters include at least one of: a surface flow rate, a stand pipe pressure, a weight-on-bit, a torque-on-bit, or a downhole bit speed.

11. A method for monitoring structural health of a bottom hole assembly (BHA) operating within a borehole, comprising:

making shear force and bending moment measurements using a downhole sensor;

reconstructing a borehole in a 3D simulation space using at least one borehole model that determines a trajectory said borehole;

calculating shear forces and bending moments along a length of a BHA along a length of said borehole by simulating a propagation of said BHA along said length of said borehole in said 3D simulation space;

calibrating said propagation based on a comparison between said shear forces and bending moments and said shear force and bending moment measurements;

condition-monitoring components of said BHA, said condition-monitoring includes condition-monitoring a first component of said components by relating said shear forces and bending moments to loads internally exerted on said first component; and providing a warning to a user when a consumed life of said first component exceeds a consumed life threshold for said first component.

12. The method of claim 11, wherein said borehole is reconstructed using a borehole over-gauge assumption that determines a diameter of said borehole along said length of said borehole from said field data.

13. The method of claim 11, wherein said simulating a propagation of said BHA includes building and placing a 3D BHA model inside said borehole and propagating said 3D BHA model along said length of said borehole.

14. The method of claim 11, wherein said relating includes using a transfer function model for said first component to relating said shear forces and bending moments to said loads internally exerted on said first component.

15. The method of claim 11, wherein said condition-monitoring said components of said BHA includes determining a fatigue damage to said first component of said BHA.

16. The method of claim 15, wherein said fatigue damage is determined by accumulating loads and operation cycles said fist component has endured during said propagation and calculating said consumed life of said first component based on said loads and operation cycles said second component has endured.

17. The method of claim 16, wherein said loads that said first component has endured are accumulated from said shear forces and bending moments.

18. The method of claim 11, further comprising monitoring a performance of a positive displacement motor (PDM) of said BHA.

19. The method of claim 18, wherein said performance is monitored by tracking performance parameters of said PDM and evaluating a downhole torque and a differential pressure at said PDM using performance functions and said performance parameters of said BHA.

20. The method of claim 19, wherein said performance parameters include at least one of: a surface flow rate, a stand pipe pressure, a weight-on-bit, a torque-on-bit, or a downhole bit speed.

* * * * *